United States Patent [19]

Motley et al.

[11] Patent Number: 4,750,251

[45] Date of Patent: Jun. 14, 1988

[54] MAT SUPPORT/SUBSTRATE SUBASSEMBLY AND METHOD OF MAKING A CATALYTIC CONVERTER THEREWITH

[75] Inventors: Michael A. Motley, Flint; Kenneth J. Pomeroy, Grand Blanc, both of Mich.

[73] Assignee: General Motors Corporation, Detroit, Mich.

[21] Appl. No.: 14,283

[22] Filed: Feb. 13, 1987

[51] Int. Cl.[4] ..... B21D 53/00

[52] U.S. Cl. ..... 29/157 R; 29/417; 53/66; 53/214; 242/7.01; 242/56 R; 422/179

[58] Field of Search ..... 29/157 R, 417, 432, 29/455; 156/353, 354, 355, 184, 187, 64, 378; 53/66, 214; 242/7.01, 56 R

[56] References Cited

U.S. PATENT DOCUMENTS

| | | | |
|---|---|---|---|
| 3,861,881 | 1/1975 | Nowak | 422/179 |
| 3,916,057 | 10/1975 | Hatch et al. | 422/179 X |
| 4,048,363 | 9/1977 | Langer et al. | 422/180 X |
| 4,070,158 | 1/1978 | Siebels | 29/157 R X |
| 4,186,172 | 1/1980 | Scholz | 29/157 R X |
| 4,385,135 | 5/1983 | Langer et al. | 422/179 X |

FOREIGN PATENT DOCUMENTS

| | | | |
|---|---|---|---|
| 2909543 | 9/1979 | Fed. Rep. of Germany | 53/66 |
| 165516 | 9/1983 | Japan | 422/179 |

*Primary Examiner*—P. W. Echols
*Assistant Examiner*—Andrew E. Rawlins
*Attorney, Agent, or Firm*—Frederick M. Ritchie

[57] ABSTRACT

A method of controlling the mount density of an intumescent mat around a frangible catalyst coated monolith of unknown but varied dimension when the monolith is installed in a catalytic converter, wherein a convolute sleeve of thin intumescent mat from a single piece is wrapped in sufficient layers around the monolith to provide a resultant monolith-mat subassembly of predetermined dimension.

3 Claims, 3 Drawing Sheets

MAT SUPPORT/SUBSTRATE SUBASSEMBLY AND METHOD OF MAKING A CATALYTIC CONVERTER THEREWITH

FIELD OF THE PRESENT INVENTION

This invention relates to catalytic converters for automotive vehicles and more particularly to monolithic converters wherein a ceramic substrate is mounted within a metal housing by an intumescent mat of expandable mica.

BACKGROUND OF THE INVENTION

Monolithic converters have in the prior art used expandable mica mat pieces to support a ceramic substrate in a metal housing. Some of such substrates have been oval in cross section and others circular. In each it is desirable to control the mount density of the mat where it supports the substrate. Intumescent mats for this purpose are selected from an inventory of mat pieces having different predetermined thicknesses. The mat thickness selected is chosen in accordance with the expected nominal gap between the ceramic substrate and its metal housing. A tongue and groove configuration is used at opposite ends of such mat pieces to interlock the mat ends when the mat is wrapped around the substrate. But the tolerance requirements of the substrate's peripheral dimension needs to be precise if the mat ends are to properly interlock and therefore the substrate is costly to produce.

In such prior art converters the tongue and groove relationship at the ends of a mat piece wrapped around a substrate may become out of alignment. Such out-of-alignment may be caused by variations in the peripheral dimension or perimeter of the substrate about which the mat piece is wrapped. If the substrate dimension strays from the nominal size on the large side, the tongue and groove ends of the mat piece are not closely juxtaposed. This creates the possibility that automobile exhaust gas can bypass the catalyst in the converter by flowing between the spaced-apart ends of the mat piece. Such flow increases the potential for erosion of the mat along the ends of the mat.

On the other hand if the substrate dimension strays from the nominal size on the small side, the tongue and groove ends of the mat piece may overlap each other. This creates the possibility that the double thickness of mat will bulge the converter housing thereat during intumescent expansion of the mat, again raising the possibility of exhaust gas bypass around the catalyst and erosion of the mat at the bulge. The bulge may also apply sufficient pressure to the substrate to fracture the substrate.

In some prior art circular monolith converters with variably sized substrates, the density of the mat is controlled by the cylindrical metal housing. This is done by squeezing or collapsing the overlapping ends of a rectangular sheet metal housing to tightly surround or hug the mat and substrate. The squeezing continues until the resultant external peripheral dimension of the housing gives the desired mat density. Then the housing ends are welded together. See, for example, U.S. Pat. No. 4,070,158.

U.S. Pat. No. 3,959,865 recognizes that it would be advantageous not to fabricate ceramic substrates to close tolerances for mounting in a housing also held to a rather close tolerance. The teaching of this patent, however, is to use organic or inorganic foam which is formed in situ between substrate and housing at an elevated temperature.

U.S. Pat. No. 4,048,363 discloses laminated intumescent mat supplied in roll form and cut to lengths which correspond to the periphery of the substrate. A single thickness of the expandable laminate is used for each substrate irrespective of the gap size between the substrate and its housing.

U.S. Pat. No. 3,861,881 also seeks to eliminate the need for stringent dimensional tolerances. To do so the patent discloses a fibrous ring made up of spirally wound layers which can be paper thin and sufficient in number to build up the thickness in accordance with the degree of thermal and shock insulation desired. The ring is not intumescent and is not tailored to a specific substrate. Thus, when the ring is press fitted over the substrate, the resultant peripheral dimension will vary depending on the substrate.

U.S. Pat. No. 4,239,733 discloses a catalytic converter having two serially arranged catalyst coated monoliths of frangible ceramic material supported in a sheet metal housing at least partially by an intumescent sleeve.

SUMMARY OF THE INVENTION

This invention contemplates an inventory of intumescent mat material in roll form rather than in mat pieces. In such roll form the thickness of the mat may be thinner than it is in mat pieces. Also contemplated is an inventory of ceramic substrates having a greater range of peripheral dimensions than would be acceptable in the prior art and, therefore, a less costly substrate.

The invention contemplates a method of measuring a peripheral dimension of each substrate and then preselecting a length of intumescent mat which is then wrapped around the substrate. The number of wraps or layers depends on the peripheral dimension of each substrate selected.

If the substrate is unusually small, a greater length of mat is selected and, when wrapped, the substrate subassembly will have a greater number of mat layers to make up the desired peripheral dimension of the subassembly. Thus when the wrapped substrate subassembly is placed in a metal converter housing, the greater number of layers automatically compensates for the smaller peripheral dimension of the substrate.

If the substrate is unusually large, a shorter length of mat is selected and, when wrapped, the substrate subassembly will have a lesser number of mat layers to make up the desired peripheral dimension of the subassembly. Thus when the wrapped substrate subassembly is placed in a metal converter housing, the lesser number of layers automatically compensates for the larger peripheral dimension of the substrate.

Accordingly it is an object of this invention to eliminate the tongue and groove joint connection for intumescent mat in monolithic catalytic converters and thus the possibility of exhaust gas bypass and mat erosion due to misaligning the two mating parts (tongue and groove). Overlap occurring due to such misalignment might cause such bypass or cracking of the brittle ceramic monolith from too high a load.

Another object of this invention is a method to control the mount density of the intumescent mat in a monolithic catalytic converter irrespective of the peripheral dimension of the monolith.

An advantage of the foregoing object lies in the ability to tailor the amount of support added to each substrate in order to achieve optimum mat mount density, whereby to achieve increased durability over prior art mat mounted monoliths in catalytic converters such as the tongue and groove design.

Another object of this invention is to control the mount density of intumescent mat material in a catalytic converter to provide improved converter durability by improving green retainment of the monolithic substrate (i.e. before the mat is cured) and by reducing mat erosion.

A more specific object of this invention is a method of assembling a catalytic converter having a monolithic ceramic substrate mounted by an intumescent mat in a housing with a controlled mount density wherein the steps comprise selecting a monolithic substrate from an inventory of such substrates having different peripheral dimensions; measuring the peripheral dimension of the monolithic substrate selected; selecting from an inventory of intumescent mat a length of such mat predetermined by the measurement of such peripheral dimension; wrapping such predetermined length of mat around the monolithic substrate; and installing the wrapped monolithic substrate in the housing, whereby the predetermined length of mat provides a controlled mount density within the housing when the temperature increases during the operating life of the converter.

Still another object of this invention is to reduce the perimeter tolerance criticality of the ceramic substrate for monolithic catalytic converters thereby to reduce the cost of the substrate. Also, since the quantity of mat support is controlled, the overall cost of the substrate could be reduced by increasing the contour or perimeter tolerances without affecting the performance of the final assembly.

Another object of this invention is to automate the subassembly of differing lengths of intumescent mat to differently dimensioned ceramic substrates thereby to provide a resultant subassembly of predetermined size for subsequent installation in converter housings.

An advantage of the preceding object is in the provision of an inventory of mat/substrate subassemblies each of which has a resultant predetermined dimension irrespective of the differing dimensions of the various substrates in the inventory.

A specific object of the invention is the provisions of a catalytic converter having two catalyst elements for purifying the exhaust gases of an internal combustion engine which comprises a tubular metal shell of predetermined peripheral dimension; a first gas pervious refractory catalyst element enclosed by the shell and spaced one distance from the inside of said shell and arranged so that flow through the element is substantially axial with respect to the axis of the shell; a second gas pervious refractory catalyst element enclosed by the shell and spaced another distance from the inside of said shell and in serial alignment with said first catalyst element for serial flow therebetween and arranged so that flow through said second catalyst element is substantially axial with respect to the axis of the shell; and first and second layered intumescent means respectively in the space formed between the shell and said first and second catalyst elements; said first intumescent means having a different number of layers than said second intumescent means whereby to compensate for the different spacing between the shell and the respective catalyst element.

These and other objects, features and advantages of the present invention will be more apparent from the following description and drawings.

DESCRIPTION OF THE PREFERRED EMBODIMENT

Figure 1:
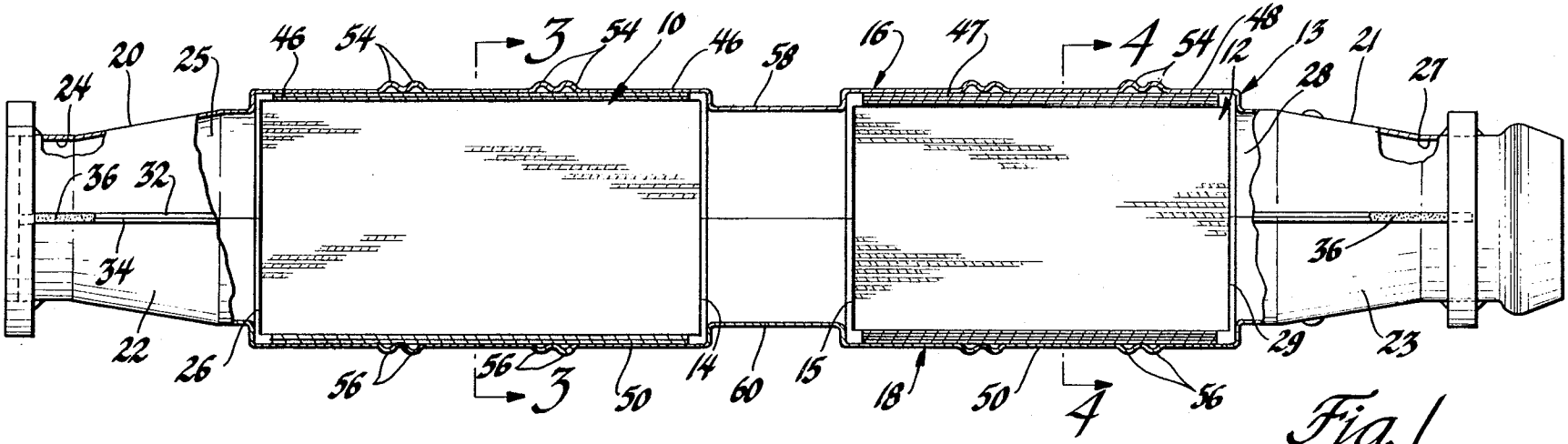
FIG. 1 is a side elevation, partly in section, of a catalytic converter having two ceramic substrates mounted in accordance with the present invention.
Figure 3:
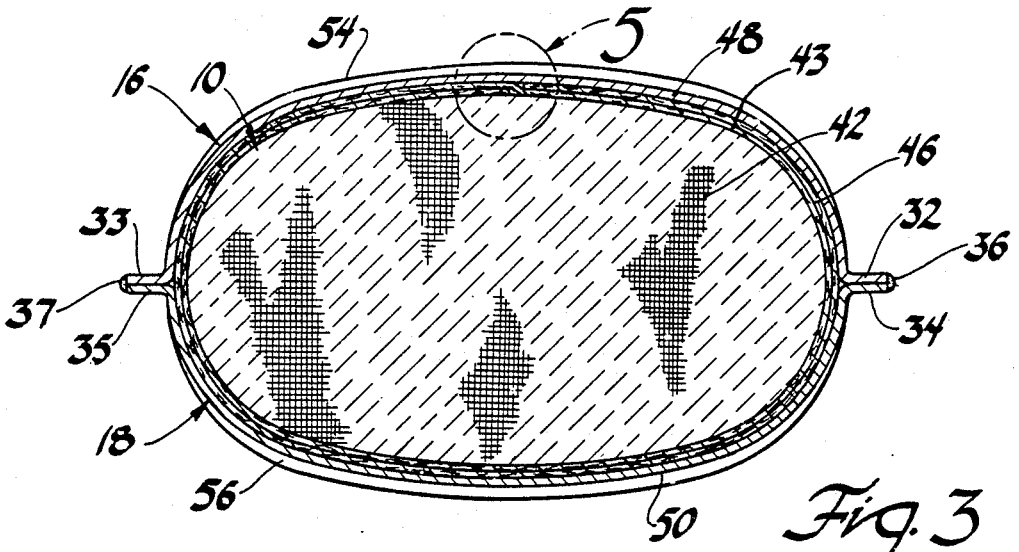
FIG. 3 is a cross-sectional view taken along line 3—3 in FIG. 1.

Referring to FIGS. 1 and 3, there is shown a catalytic converter embodying the present invention for use in a vehicle to purify the exhaust gases from an internal combustion engine. The converter generally comprises a pair of catalyst coated monoliths 10 and 12 which are mounted end to end in a sheet metal housing 13 of the clamshell type with their respective inner ends 14 and 15 facing each other. The housing 13 consists of a pair of shell members 16 and 18 which cooperatively enclose the peripheral sides of the monoliths and, in addition, have integrally formed funnel portions 20, 21 and 22, 23, respectively, at opposite ends thereof. The respective funnel portions 20 and 22 of the shell members 16 and 18 cooperatively form a circular cylindrical opening 24 in one end of the housing and also an internal passage 25 which diverges outwardly therefrom to expose this opening to the entire outer end 26 of monolith 10. The other funnel portions 21 and 23 cooperatively form a circular cylindrical opening 27 in the other end of the housing and also an internal passage 28 which diverges inwardly therefrom to expose this opening to the entire outer end 29 of the other monolith 12. In addition, and with reference to FIGS. 3 and 4, the respective shell members 16 and 18 have co-planar flanges 32, 33 and 34, 35 which extend along opposite sides and between the ends thereof. The respective flanges 32, 33 mate with the flanges 34, 35 and are permanently, sealingly welded together by separate welds 36 and 37 along the edges thereof. In addition to edge welding, this invention contemplated roller seam welding as well.

The housing's respective cylindrical openings 24 and 27 are adapted to receive connector pipes (not shown). These pipes are sealingly fixed about their periphery to the edge of the respective housing openings and are adapted to connect the converter in the engine's exhaust system so that the exhaust gases enter the first monolith 10 and exit from the other monolith 12.

Figure 4:
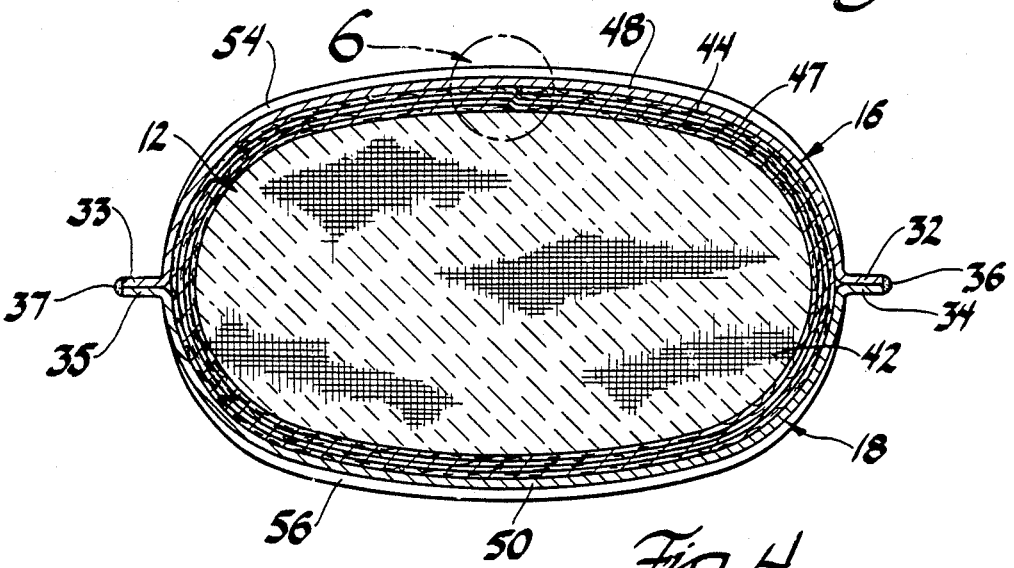
FIG. 4 is a cross-sectional view taken along line 4—4 in FIG. 1.
Figure 5:
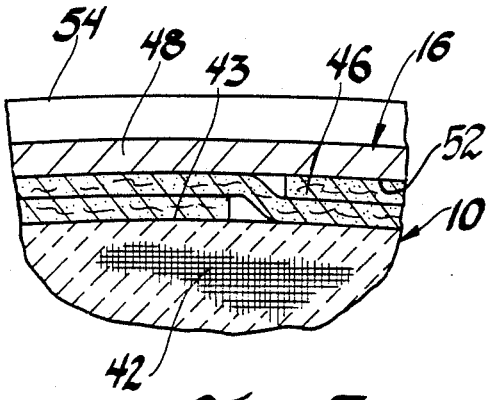
FIG. 5 is an enlargement of the sectioned layers circled in view 5 in FIG. 3.
Figure 6:
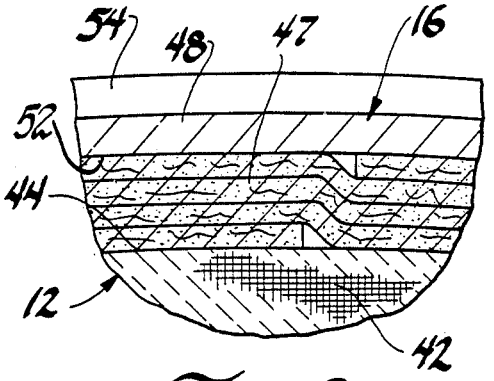
FIG. 6 is an enlargement of the sectioned layers circled in view 6 in FIG. 4.

The monoliths 10 and 12 are constructed of a frangible material such as ceramic and are extruded with an identical honeycomb cross section 42 and an oval cylindrical periphery 43, 44, as shown in FIGS. 3 and 4 respectively, such oval shape providing for a low converter profile as compared to width for under-floor vehicle installation where accommodating space height is very limited. The monoliths 10 and 12 are coated with a suitable 3-way reduction, or oxidation catalyst for purifying the exhaust gases entering through the opening 24 serving as the housing inlet and prior to exiting the opening 27 serving as the housing outlet by reduction and oxidation processes as is well known in the art.

The housing 13 consisting of the shell members 16 and 18 is preferably constructed of stainless steel sheet or some other high temperature non-corrosive metal sheet and thus has a substantially higher rate of thermal expansion than that of the ceramic monoliths 10 and 12. As a result, the housing expands away from the monoliths as the converter heats up and some provision must be made for both supporting and sealing the monoliths to prevent fracture thereof and bypassing or internal leakage of the exhaust gases past their interior.

Monolithic converters have in the prior art used expandable mica mat pieces 70 to support a ceramic substrate 72 in a metal housing 74. See, for instance, FIG. 2. Some of such substrates have been oval in cross section and others circular. In each it is desirable to control the mount density of the mat where it supports the substrate. Intumescent mats for this purpose were selected from an inventory of mat pieces having different predetermined thicknesses. The mat thickness selected has been chosen in accordance with the expected nominal gap 76 between the ceramic substrate 72 and its metal housing 74. A tongue 80 and groove 82 configuration is used at opposite ends 84, 86 of such mat pieces to interlock the mat ends when the mat is wrapped around the substrate. Such configuration is used to attach the mat to the substrate by means of staples 90. But the tolerance requirements of the substrate's peripheral dimension needs to be precise if the mat ends 84, 86 are to properly interlock and seal against exhaust gas bypassing the monolith and, therefore, the substrate is costly to produce.

Figure 2:
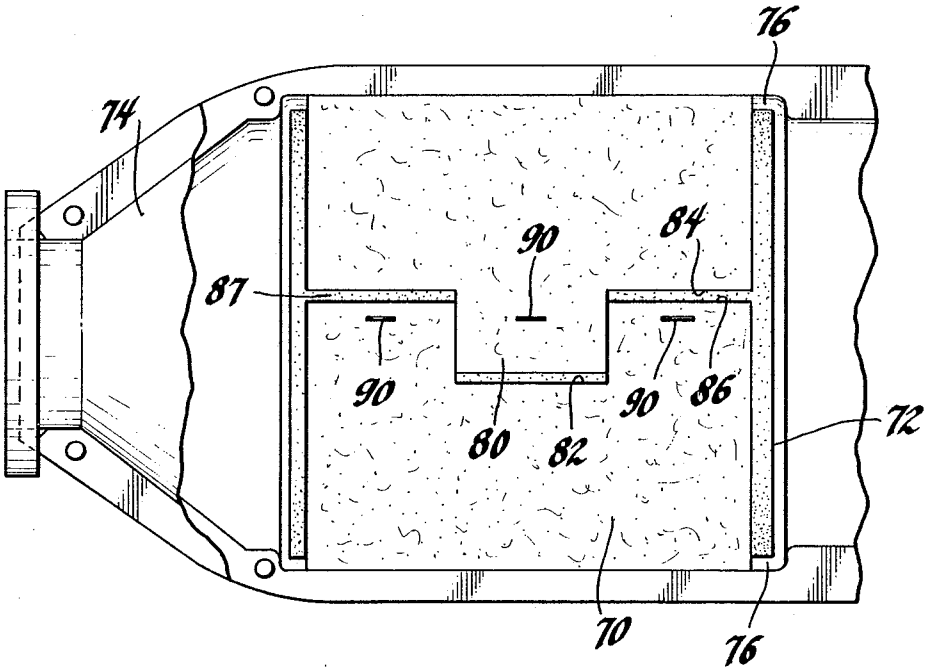
Fig. 2 PRIOR ART
FIG. 2 is a fragmentary top elevation, with parts broken away, to show the prior art intumescent mat support in a catalytic monolith converter improved by this invention.

In such prior art converters the tongue and groove relationship at the ends of a mat piece wrapped around a substrate may become out of alignment. Such out-of-alignment may be caused by variations in the peripheral dimension or perimeter of the substrate 72 about which the mat piece 70 is wrapped. If the substrate dimension strays too far from the nominal size on the large side, the tongue and groove ends of the mat piece are not closely juxtaposed as shown in FIG. 2 and the gap 87 opens up. This creates the possibility that automobile exhaust gas can bypass the catalyst in the converter by flowing between the opened-up and spaced-apart ends 84, 86 of the mat piece. Such flow increases the potential for the erosion of the mat along the ends of the mat.

On the other hand if the peripheral dimension of the substrate 72 strays too far from the nominal size on the small side, the tongue and groove ends of the mat piece may overlap each other. For instance, tongue 80 may overlap the mat portion forming the groove 82. This creates the possibility that the double thickness of mat will bulge the converter housing overlying this double thickness during intumescent expansion of the mat, again raising the possibility of exhaust gas bypass around the catalyst coated monolith and erosion of the mat at the bulge. The bulge may also apply sufficient pressure to the substrate to fracture the substrate.

Longitudinal misalignment of the tongue and groove due to processing variations may also cause overlap. This invention avoids the tongue and groove altogether.

According to the present invention, each of the monoliths 10 and 12 is separately supported by convolute sleeves 46, 47 of resilient heat expandable instrumescent material such as that known by the trade name Interam and made by 3M Company. The intumescent sleeves 46, 47 respectively encompass the entire cylindrical surfaces 43, 44 of the respective monoliths with the axial length of the intumescent sleeve being substantially coextensive with the monolith and centered thereon.

To then make use of this type monolith support, the respective housing shell members 16 and 18 are formed with intermediate partial-cylindrical portions 48 and 50 which are partial-oval in cross section as viewed in FIGS. 3 and 4 and cooperatively provide on their interior side an oval cylindrical surface 52 which corresponds to and is spaced radially outward from the respective surfaces 43, 44 of the respective monoliths so as to define a cylindrical space therebetween for the intumescent sleeves 46, 47. For increased housing stiffness to resist bulging out in this area on converter heat-up, the respective housing portions 48 and 50 have integrally formed pairs of axially spaced, laterally extending ribs 54 and 56. And for increased housing stiffness between the two monoliths, the respective shell members 16 and 18 are further formed with partial-annular rib portions 58 and 60 which extend slightly radially inward of the edges of the inner ends 14 and 15 of the monoliths.

The intumescent sleeves 46, 47 which preferably have a rectangular cross-section as seen in FIG. 1 are intended to swell on first converter heat-up to provide tight sealing and support of the monolith.

The problem is the supplier's cost of closely holding the peripheral dimension of ceramic monoliths. According to the present invention, holding the peripheral dimension to a close tolerance is not needed. Instead of maintaining an inventory of expensive, close-tolerance, ceramic, monolithic substrates, this invention contemplates a mat support/substrate subassembly which is within tolerance and sized to the converter housing irrespective of the variably sized substrate supplied.

Figure 7:
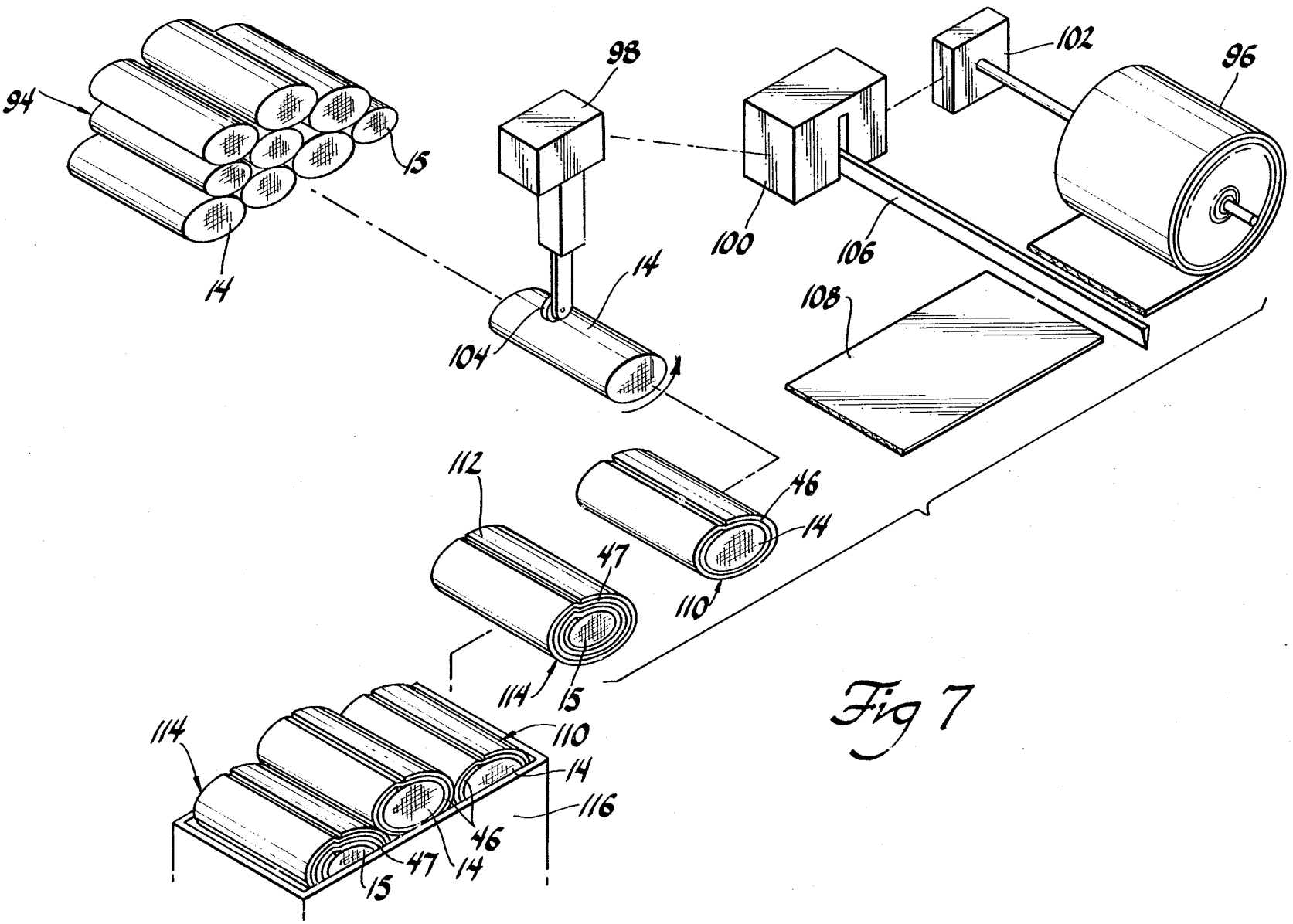
FIG. 7 is a schematic view of a method of making monolith converters embodying the present invention.

Turn now to FIG. 7 for a description of the method of making the catalytic converter of this invention. First, manufacturing the mat support/substrate subassembly requires an inventory 94 of ceramic monolithic substrates such as 14, 15. Substrate 14 may be oversize. Substrate 15 may be undersize. It doesn't matter.

Next, we need a roll 96 of intumescent mat support material. The basis weight may be $1050 \pm 105$ g/M$^2$, Series I Mat Support from 3M Company with a thickness of $1.7 \pm 0.26$ mm. Although the mat thickness is not critical, it should be thin enough that the nominal spacing between substrate and housing will permit multiple layers of mat support material.

Then we provide integrated processing equipment which includes a measuring device 98, a cutting device 100 and an unrolling device 102.

In operation, a substrate is selected. Say, oversize substrate 14. The measuring device rotates the substrate past a wheel 104 which measures the peripheral dimension of the substrate. This dimension is signalled to the cutter 100 which activates a knife 106 to cut off a length of mat 108 determined by the controlled dispensing of roll 96.

Mat 108 is wrapped around oversized substrate 14 to form sleeve 46 and mat support/substrate subassembly 110. At the start two staples are used in the preferred embodiment, one near each monolith face. The mat is finished by three pieces of tape in the preferred embodiment, one in the center and one near each monolith face. During wrapping, the edge of wrapped mat is to be in line with previous layer. The process is repeated with undersize substrate 15. A longer mat length 112 is cut and wrapped around the undersized substrate 15. This forms sleeve 47 and mat support/substrate subassembly 114.

Inventory 116 is made up of subassemblies 110 and 114. The peripheral dimension of subassembly 110 is the same as subassembly 114 even though the latter has a greater length of mat wrapped as a convolute thereon than does subassembly 110. The greater number of mat layers in subassembly 114 makes up for its undersized substrate.

When the converter is assembled in the configuration of FIG. 1, any subassembly such as 110, 114 in inventory 116 may be selected. Since the housing is constant, the number of mat layers compensates for any difference in substrate size.

With the converter thus assembled and then on its first heat-up in the vehicle, the intumescent sleeves 46, 47 at each of the monoliths swells and is resisted by the stiffened housing portions 48 and 50 and is thereby caused to exert substantial restraining pressure between the stiffened housing and the monolith without fracturing the monolith and without causing bulging of the heated housing because of such increased radial stiffening of the latter. Thereafter, the intumescent sleeves 46, 47 remain effective to provide tight sealing between the housing and the monolith at the inlet end thereof while also remaining sufficiently resilient to provide resilient radial support of the monolith and also relative axial location thereof as the housing expands with heat.

While a preferred embodiment of the invention has been illustrated, it will be appreciated that modifications are in the spirit and scope of the invention. For example, the oval shape of the monoliths while providing for a low profile converter also helps to prevent rotation of the monolith within the housing; however, the monolith could be formed of some other cross-sectional shape, such as circular with the intumescent seal and support arrangement modified accordingly since the intumescent material has been found to provide a very effective means of also preventing rotation of the monolith in addition to providing resilient radial and axial restraint thereof.

Thus, the above described preferred embodiment is intended to be illustrative of the invention which may be modified within the scope of the appended claims.

The embodiment of the invention in which an exclusive property or privilege is claimed are defined as follows.

1. A method of assembling a catalytic converter having a monolithic ceramic substrate mounted by an intumescent mat in a housing with a controlled mount density comprising the steps of:

selecting a monolithic substrate from an inventory of such substrates having different peripheral dimensions;

measuring the peripheral dimension of the monolithic substrate selected;

selecting from an inventory of intumescent mat a length of such mat predetermined by the measurement of such peripheral dimension;

wrapping such predetermined length of mat around the monolithic substrate; and installing the wrapped monolithic substrate in the housing, whereby the predetermined length of mat provides a controlled mount density within the housing when the temperature increases during the operating life of the converter.

2. A method of controlling the mount density of an intumescent mat around a ceramic substrate of unknown but varied dimension when the substrate is installed in a monolithic catalytic converter housing of fixed dimension comprising the steps of:

selecting at random a ceramic substrate;

and wrapping sufficient convolute layers of mica mat about the selected ceramic substrate to effect a resultant mat/substrate subassembly of predetermined dimension to compensate for the variations in such substrate dimension whereby the mat mount density remains within predetermined values when installed in such converter irrespective of the variations in the dimension of the substrate selected.

3. A method of controlling the mount density of an intumescent mat around a frangible substrate of unknown but varied dimension when the substrate is installed in a monolithic catalytic converter housing of fixed dimension comprising the steps of:

selecting at random a frangible substrate;

and wrapping sufficient convolute layers of mica mat about the selected frangible substrate to effect a resultant mat/substrate subassembly of predetermined dimension to compensate for the variations in such substrate dimension whereby the mat mount density remains within predetermined values when installed in such converter irrespective of the variations in the dimension of the substrate selected.

* * * * *